US009567830B2

(12) United States Patent
Collins

(10) Patent No.: US 9,567,830 B2
(45) Date of Patent: Feb. 14, 2017

(54) TRANSITION TOOL AND METHOD

(76) Inventor: Bryan L. Collins, Harrison, OH (US)

( * ) Notice: Subject to any disclaimer, the term of this patent is extended or adjusted under 35 U.S.C. 154(b) by 542 days.

(21) Appl. No.: 13/200,011

(22) Filed: Sep. 15, 2011

(65) Prior Publication Data

US 2013/0068471 A1 Mar. 21, 2013

(51) Int. Cl.

| | |
|---|---|
| ***E21B 34/06*** | (2006.01) |
| ***E21B 35/00*** | (2006.01) |
| ***E21B 33/00*** | (2006.01) |
| ***E21B 43/01*** | (2006.01) |
| ***E21B 17/00*** | (2006.01) |
| ***E21B 33/035*** | (2006.01) |

(52) U.S. Cl.

CPC ..... *E21B 34/06* (2013.01); *E21B 33/035* (2013.01); *E21B 35/00* (2013.01); *E21B 43/0122* (2013.01); *E21B 17/00* (2013.01); *Y10T 137/598* (2015.04)

(58) Field of Classification Search

CPC ..... E21B 33/02; E21B 35/00; E21B 34/06; E21B 43/0122; E21B 33/035; F16K 43/00

USPC ..... 166/97.1, 85.1, 85.3, 85.4, 85.5, 92.1,166/96.1, 373, 379, 91.1; 138/39, 42, 44; 285/148.18, 23, 25

See application file for complete search history.

(56) References Cited

U.S. PATENT DOCUMENTS

| | | | | | |
|---|---|---|---|---|---|
| 864,149 | A * | 8/1907 | Bell | 169/69 | |
| 1,485,862 | A * | 3/1924 | Lester | 166/97.1 | |
| 1,822,140 | A * | 9/1931 | Gallaher | 166/97.1 | |
| 1,888,621 | A * | 11/1932 | Collins | 166/79.1 | |
| 2,888,079 | A * | 5/1959 | Cypher | E21B 33/1265 166/135 | |
| 2,963,090 | A * | 12/1960 | Focht et al. | 33/645 | |
| 3,094,124 | A * | 6/1963 | Birtwell | 604/523 | |
| 3,282,355 | A * | 11/1966 | Henderson | 175/61 | |
| 4,201,267 | A * | 5/1980 | Ramhorst | E21B 33/03 166/373 | |
| 4,919,127 | A * | 4/1990 | Pell | 128/207.14 | |
| 5,150,752 | A * | 9/1992 | Gunst | 166/97.1 | |
| 5,213,157 | A * | 5/1993 | Wills | 166/79.1 | |
| 5,361,840 | A * | 11/1994 | Matthews | E21B 29/00 166/135 | |
| 5,947,528 | A * | 9/1999 | Campbell | 285/16 | |
| 8,434,557 | B2 * | 5/2013 | Chaddick | F17D 1/00 166/344 | |
| 8,474,543 | B2 * | 7/2013 | Kotefski et al. | 166/386 | |
| 8,720,585 | B2 * | 5/2014 | Mothaffar | E21B 33/12 166/192 | |
| 8,820,411 | B2 * | 9/2014 | Churchill | E21B 33/064 166/345 | |

(Continued)

*Primary Examiner* — Jennifer H Gay

(74) *Attorney, Agent, or Firm* — Mark R. Wisner

(57) ABSTRACT

A throttling valve formed by introducing an elongate tubular body into a tubular member through which fluid is flowing. The tubular body is provided with first and second ends, the first end being adapted for engaging a flow control device and the second end having a beveled end that enables fluid communication between the tubular member and the tubular body. The tubular body is provided with a tapered stem, the outside diameter of the stem proximate the first end of the tubular body being greater than the outside diameter of the stem proximate the second end, for seating against the opening in the end of the tubular member and effecting a seal between the outside surface of the stem and the margin of the opening in the tubular member. An elastomeric or other seal may be mounted on the outside surface of the stem for this same purpose.

11 Claims, 3 Drawing Sheets

(56) References Cited

U.S. PATENT DOCUMENTS

| | | | | |
|---|---|---|---|---|
| 2009/0014071 | A1* | 1/2009 | Baugh | 137/493.2 |
| 2011/0306254 | A1* | 12/2011 | Woods | 440/89 C |
| 2012/0018174 | A1* | 1/2012 | Kotefski et al. | 166/386 |
| 2012/0160509 | A1* | 6/2012 | Caldwell | E21B 33/037 166/363 |
| 2013/0020086 | A1* | 1/2013 | Anderson et al. | 166/339 |
| 2013/0068471 | A1* | 3/2013 | Collins | 166/373 |
| 2013/0341539 | A1* | 12/2013 | Hughes et al. | 251/1.3 |

* cited by examiner

TRANSITION TOOL AND METHOD

BACKGROUND OF THE INVENTION

The present invention relates to an apparatus for adaptive transitioning from a tubular member to a device to be mounted on the tubular member. In another aspect, the present invention relates to a method for regaining pressure control of an underground hydrocarbon reservoir. In more detail, the present invention relates to an apparatus that is introduced into the open end of a tubular member, particularly a tubular member such as a well head, from which fluids are escaping for mounting a device to the tubular member for capturing, or controlling, the flow of the fluids from the tubular member.

A common problem that arises in many industries in which fluids are moved through pipes and/or other types of tubular members, especially under pressure, is a break in the pipe, apparatus, device failure, or tubular member, particularly in a situation in which it is difficult and/or time-consuming to either reduce the flow or pressure of the fluid moving through the pipe or tubular member to enable the repair of the break. Examples, including hydrocarbon refining, hydrocarbon production and transport, water treatment and distribution, steam distribution, refrigeration, production of geothermal energy, and pipeline transmission, are all too frequent. A particularly difficult situation is the loss of pressure control of an underground hydrocarbon reservoir (a so-called blowout) because the only way to regain control of the pressure of the reservoir is by operations that are conducted from the surface (or from the floor of the body of water if the well is not located on land).

Because the fluid is often under pressure, such breaks can be catastrophic and may cause damage to the tubular member or pipe, making remedial action difficult. The primary goal of the remedial action is usually to capture, or even shut off, fluid flow from the tubular member, which usually involves mounting a flow control device or additional pipe to the tubular member in fluid communication with the interior of the tubular member. The particular problem presented by such a situation is to provide a way to mount or affix the flow control device, piping, or other device to the tubular member while fluid is flowing through the tubular member and to obtain a seal with the tubular member that minimizes the leaking of fluids from the interior of the tubular member. Various tools and devices have been developed that clamp onto or otherwise interact with the tubular member to provide a mount for a flow control device, pipe, or other device, but what is needed is a tool that provides a transition from the pipe or tubular member to the flow control or other device that is introduced into the open end of the tubular member to effect a seal with the tubular member, that provides a mount for the flow control, pipe, or other device, and that provides passage for the fluid from tubular member to the flow control, pipe, or other device.

It is, therefore, an object of the present invention to provide an adaptive transition tool for mounting to the open end of a tubular member having fluid flow therethrough for transitioning from the open end of the tubular member to a flow control device, pipe, or other device for controlling or capturing the fluid flowing through the tubular member.

Another object of the present invention is to provide an adaptive transition tool for sealing against the open end of a tubular member having fluid flowing therethrough and for providing a mount for a flow control device, pipe, or other device for capturing or shutting off fluid flow through the tubular member that is capable of effecting the seal over a range of diameters of the tubular member and when the tubular member is not round.

Another object of the present invention is to provide an adaptive transition tool for use in capturing and/or controlling the flow of fluid escaping from the open end of a tubular member through which fluid flow is maintained and that is capable of being introduced into the open end of the tubular member even when fluid is exiting from the tubular member in high volume and/or high pressure.

Another object of the present invention is to provide an adaptive transition tool having a configuration that assures alignment with the tubular member through which fluid is flowing by equalizing the pressure of the fluid against the tool as the tool is inserted into the open end of the tubular member and so as to seat the outside surface of the tool on the opening in the end of the tubular member.

Still another object of the present invention is to provide a method for regaining control of the pressure of an underground hydrocarbon reservoir after a loss of pressure control that causes damage to the wellhead.

Other objects, and the many advantages of the present invention, will be made clear to those skilled in the art in the following detailed description of the preferred embodiments of the present invention and the drawings appended hereto. Those skilled in the art will recognize, however, that the embodiments of the invention described herein are only examples provided for the purpose of describing the making and using of the present invention and that they are not the only embodiments of adaptive transitions tools that can be constructed in accordance with the teachings of the present invention.

SUMMARY OF THE INVENTION

The present invention addresses the above-described problem by providing an apparatus for transitioning an open end of a tubular member having fluid flowing therethrough to a flow control device comprising an elongate tubular insertion body, a first end of said tubular insertion body adapted for engaging a flow control device, the second end of said tubular insertion body having a beveled end for insertion into the fluid flowing through the tubular member, the outside diameter of the first end of said tubular insertion body tapering to a smaller outside diameter at the second end of said tubular insertion body.

In another aspect, the present invention provides a method for regaining control of the pressure of an underground hydrocarbon reservoir after a loss of pressure control that causes damage to the wellhead comprising the steps of lowering the tapered stem of an insertion tool into the wellhead and seating the tapered outside surface of the stem of the insertion tool on the margins of the opening into the wellhead while maintaining the flow of fluid from the underground hydrocarbon reservoir through the insertion tool. A flow control device is mounted to the insertion tool and a valve in the flow control device is closed to regain control of the pressure of the reservoir.

BRIEF DESCRIPTION OF THE DRAWINGS

Referring now to the figures.

DETAILED DESCRIPTION OF THE PREFERRED EMBODIMENT(S)

Figure 1:
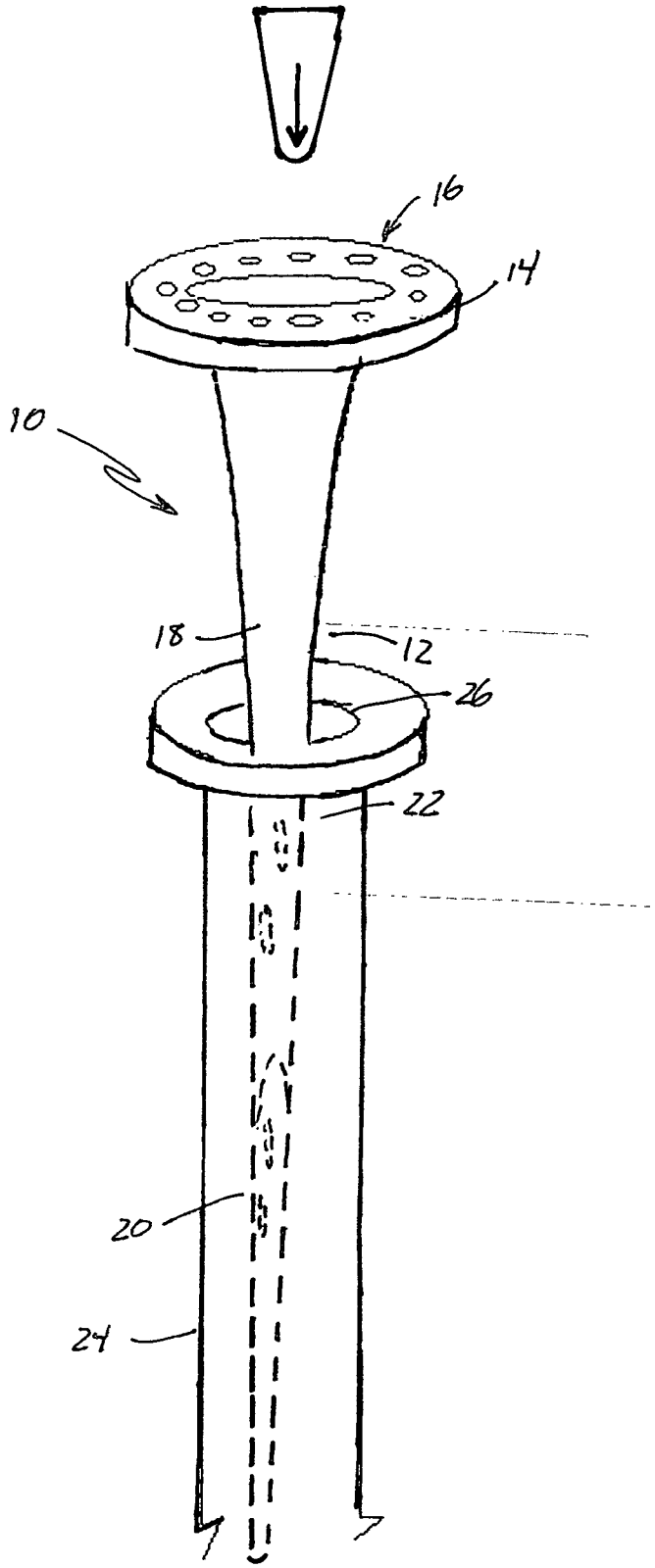
FIG. 1 shows a schematic view of one embodiment of an adaptive transition tool constructed in accordance with the teachings of the present invention for use in mounting a flow control device to a well head.

In more detail, a first embodiment of the transition tool of the present invention is shown schematically in FIG. 1. The transition tool, indicated generally at reference numeral 10, includes an elongate tubular insertion body 12 having a first end 16 adapted for engaging a flow control device (not shown) in the form of a flange 14 integral with first end 16 and a tapered stem 18 terminating in a beveled second end 20 of insertion body 12. Although a flange is shown in this particular embodiment as being the structure to which a flow control device is mounted, those skilled in the art who have the benefit of this disclosure will recognize that structure other than a flange may also be used to advantage for this purpose. Twist-lock connectors, compression fittings, threaded connectors, and many other types of structure in addition to flanges are contemplated by references to the adapting of the first end 16 for engaging a flow control device. The beveled end facilitates insertion of tubular insertion body 12 into the open end 26 of tubular member 24 in the event of an obstruction caused by, for instance, damage to the tubular member 24 or debris. A plurality of perforations 22 through the wall of insertion body 12 are spaced along the portion of stem 18 that extends into tubular member 24 for maintaining the flow of fluid passing through tubular member 24 as the stem 18 is lowered into the open end 26 of tubular member 24. Stem 18 is tapered from first end 16 to second end 20, the outside diameter near first end 16 being greater than the outside diameter proximate second end 20, so that as insertion body 12 is lowered into the open end 26 of tubular member 24, the outside surface of stem 18 contacts the margin of the opening in the open end 26 of tubular member 24. Although not visible because of the perspective nature of FIG. 1, a seal is positioned on the outside surface of stem 18 at the point of contact with the margin of the opening in the open end 26 of tubular member 24.

In the particular embodiment shown in FIG. 1, the tubular member 24 is the riser or well head of a subsea oil well, for instance, a subsea well head in which pressure control has been lost as a result of, for instance, failure of the tubing or cement in the well or damage or loss of function of the well head equipment, and the flange 14 of transition tool 10 is adapted for engaging a flow control device (not shown) such as a choke or valve stack. Those skilled in the art who have the benefit of this disclosure will recognize, however, that a well head is but one application for the apparatus of the present invention and that the invention can be exemplified by use in, for instance, a geothermal well. Similarly, the tubular member into which the tapered stem 18 of insertion body 12 is introduced need not be vertical; the taper in stem 18 enables the insertion tool 10 of the present invention to achieve the desired seal with the margin of the opening at the open end of a tubular member that is horizontal such as refinery piping and/or a high pressure steam or refrigeration line.

In the application shown in FIG. 1, however, the insertion tool 10 of the present invention provides certain additional advantages and functions. For instance, if fluid is flowing from the opening in tubular member 24 at high pressure, the taper of stem 18 minimizes the surface area of insertion tool 10 that is exposed to the high pressure fluid and equalizes the pressure around the tool, thereby minimizing any tendency of the stem 18 to be deflected by fluid impinging upon the surface of stem 18 and facilitating introduction of the tool into the open end of the tubular member 24. The bevel at the second end 20 of insertion body 12 functions to decrease turbulence in the flow of fluid that is maintained as the body 12 is lowered into tubular member 24. Further, the weight of a flow control device (which may be 25, or even 150, tons in the case of a valve stack for a subsea wellhead and depending upon the particular application) functions to increase the likelihood of a fluid tight seal between the outside diameter of the stem 18 of insertion body 12 and the opening at the open end 26 of tubular member 24 by effectively forcing the second end of tubular member down into the open end 26 of tubular member 24. As a result of the taper in stem 18, movement of the second end 20 further into the interior of tubular member 24 tightens the seal against the open end 26 of tubular member 24.

Even in applications in which the tubular member 24 is horizontal, movement of the second end 20 of insertion body 12 further into tubular member 24 is utilized to advantage. For instance, as a result of damage to the tubular member, the tubular member might not be round, in which case, the taper on stem 18 acts to both center stem 18 as it is introduced into the tubular member 24 so as to seat the surface of stem 18 on the margins of the open end 26 of tubular member 24 but also as a swaging tool to open up and to restore the shape of the opening, effecting a better seal between the outside diameter of stem 18 and the margins of the open end 26 of tubular member 24. This latter function is of such advantage that in one embodiment (not shown), hydraulic or screw jacks, or hydraulic rams, are provided for forcing the second end 20 of insertion tool 10 into tubular member 24. Alternatively, the second end 20 of tool 10 can be forced into tubular member 24 simply by pounding, for instance, with a sledge hammer or air-powered jack hammer against a plate that is mounted to the flange at the first end 16 of insertion body 12. Because there are so many ways to force the second end 20 of tool 10 into the open end 26 of tubular member 24, reference is made herein to "means for forcing" the second end 20 of tool 10 into the open end 26 of tubular member 24.

Figure 2:
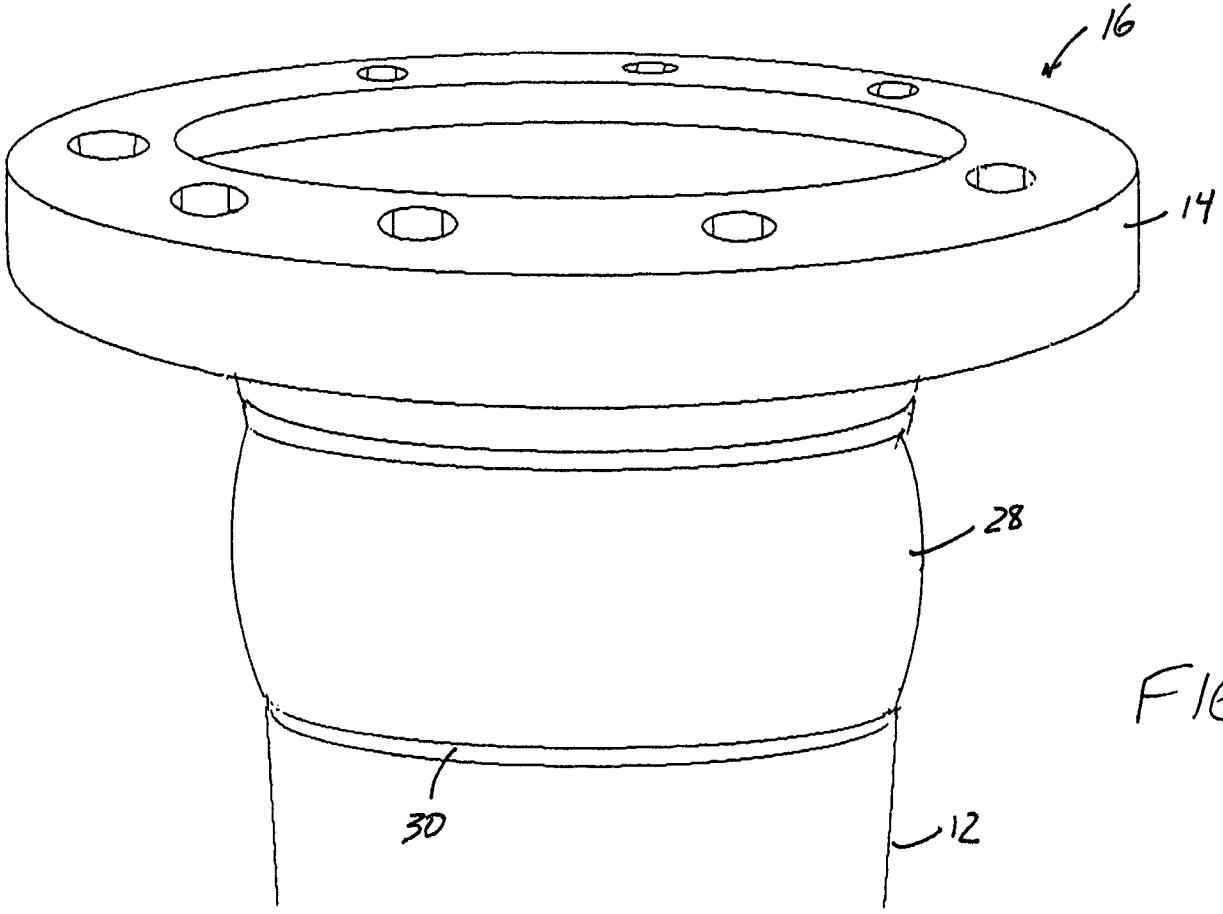
FIG. 2 is a detail view of a portion of the transition tool of FIG. 1 showing a seal mounted on the outer surface of the tool.

Referring now to FIG. 2, the seal on the outside surface of stem 18 is shown in more detail. It is generally preferred that seal 28 be comprised of a resilient material that deforms when seal 28 is compressed, for instance when the outside surface of insertion body 12 contacts the margins of the open end 26 of tubular member 24, but the particular material or materials is/are selected in accordance with the particular application; similarly, the type of seal and the cross-sectional shape of the seal is chosen depending upon the particular application, all in accordance with factors known to those skilled in the art. Seal 28 resides in an annular groove 30 in the outside surface of insertion body 12; again, the configuration of groove 30 depends upon the particular application and the seal that is selected for the application, all as known to those skilled in the art, the shape and configuration of seal 28 and groove 30 being shown in FIG. 2 for purposes of exemplification. Although not a requirement of the present invention, in the embodiment shown, seal 28 extends along the outside surface of insertion body 12 for sufficient distance to maintain a seal as the first end 16 of insertion body 12 as the insertion body 12 moves downwardly as a result of being forced into tubular member 24.

Figure 3:
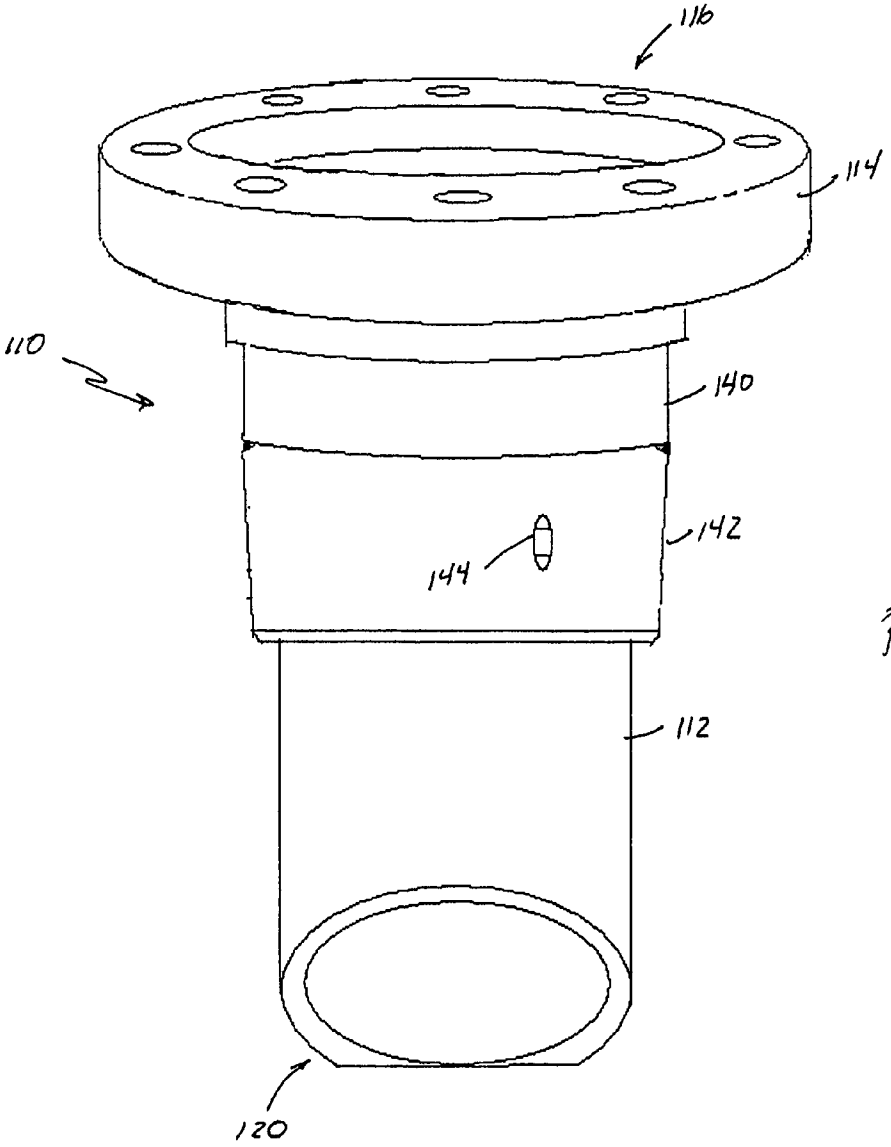
FIG. 3 is a perspective view of a second embodiment of the adaptive transition tool of the present invention.

A second embodiment of the insertion tool of the present invention is indicated generally at reference numeral 110 in FIG. 3. As with the insertion tool 10 shown in FIGS. 1-2, insertion tool 110 comprises a tubular insertion body 112 having a first end 116 adapted for engaging a flow control device (not shown), and a second end 120 having a beveled end. As with insertion tool 10, the first end 116 of insertion tool 112 is adapted for engaging a flow control device and, in the embodiment shown, the first end 116 os provided with a flange 114 to which the similarly shaped and sized flange of the flow control device is mounted. Unlike the insertion tube 12 shown in FIGS. 1-2, the tubular insertion body 112 of insertion tool 110 is not tapered along stem 118. Instead of tapering the stem, the outside diameter of a seal cup 140 that rides on the outside surface of insertion body 112 is tapered from the portion proximate the first end 116 toward the second end 120 of insertion body 112. Seal cup 140 is provided with internal seals (not visible in FIG. 3) as described below. An internally-threaded locking ring 142 is carried on a set of threads (not visible) on the outside surface of insertion body 112 for rotation upwardly on insertion body 112 to energize the seals in seal cup 140. Again, the outside surface of locking ring 142 is tapered from a larger diameter at the end of locking ring 142 proximate the first end 116 of insertion body 112 to the end proximate the second end 120 of insertion body 112. Because the seal cup 140 and locking ring 142 are, in effect, integral with insertion body 112, it is intended that the references to the taper of the insertion body set out herein should include the structure shown in FIG. 3 in which the taper, rather than being located on the stem of the insertion body 112, is located on the outside surface of the seal cup 140 and/or locking ring 142. A locking, or set, screw 144 is provided for retaining the locking ring 142 in the position on the insertion body 112 in which the seals are energized.

The particular configuration and composition of the seals carried in seal cup 140 depends, as described above in connection with the embodiment shown in FIGS. 1-2, on the particular application in which insertion tool 110 is utilized and the selection of the configuration and composition of the seals is accomplished in accordance with information known to those skilled in the art. As set out above, it is generally preferred that the seals be comprised of a resilient elastomeric material or other formable or other application-specific material so that, when energized and after insertion into the open end of a tubular member (not shown in FIG. 3), the seals expand radially outwardly into engagement with the margins of the open end of the tubular member so as to effect a seal with the tubular member.

A method of regaining control of the pressure of an underground hydrocarbon reservoir after a loss of pressure control that causes damage to the wellhead will now be described with reference to the structure of the insertion tool of the present invention. After the wellhead has been cleared of debris, the tapered stem of the insertion tool of the present invention, for instance, the insertion tool 10, is lowered into the wellhead. Because of the taper of the stem 18, insertion tool 10 can be lowered into the wellhead even if the riser was bent and/or is not vertical as a result of damage caused by the loss of pressure control and even if the riser has been deformed such that the margin of the opening at the top of the tubular riser is not round. The tapered outside surface of the stem 18 of insertion tool 10 is then seated on the margins of the opening into the riser, the beveled end of stem 18 functioning to maintain the flow of fluid from the underground hydrocarbon reservoir through the insertion body 12 of insertion tool 10 while the tool 10 is seated. Any tendency of the insertion body 12 to be deflected out of alignment with the axis of the wellhead riser by impingement of the fluid escaping from the riser on the insertion body 12 is reduced by the taper on the outside surface of stem 18 and equalizes the flow of fluid around stem 18 as insertion tool 10 is lowered into the riser by routing the flow through the perforations 22 in stem 18.

Again, if the wellhead riser is out of round, the taper in stem 18 functions in a manner similar to a swaging tool to re-shape the margins of the opening into the riser; if the need arises, the insertion body 12 can even be rocked back and forth and/or driven down into the opening in the riser (see the discussion of the forcing means, above) so as to obtain a more effective seal between the seal 28 mounted in groove 30 on the outside surface of insertion body 12 and the margins of the opening into the riser. A flow control device is then mounted to the insertion tool, for instance, by mounting to flange 14, and a valve on the flow control device is then closed.

In another preferred embodiment of a method of regaining pressure control in accordance with the present invention, one or more relief wells are drilled into the same underground hydrocarbon reservoir from which fluids are escaping. In this second embodiment of the method of the present invention, the insertion tool 10 provides temporary pressure control while the relief well(s) is being drilled. Alternatively, the valve on the flow control device mounted to insertion tool 10 is not closed until after the relief well(s) are completed such that the insertion tool 10 and the relief well(s) together provide a permanent solution to the problem of regaining pressure control.

Those skilled in the art who have the benefit of this disclosure will recognize that certain changes can be made to the component parts of the apparatus of the present invention without changing the manner in which those parts function and/or interact to achieve their intended result. All such changes, and others that will be clear to those skilled in the art from this description of the preferred embodiments of the invention, are intended to fall within the scope of the following, non-limiting claims.

What is claimed is:

1. Apparatus for transitioning an open end of a tubular member to a flow control device while maintaining a flow of fluid out of the open end of the tubular member, the apparatus comprising an elongate tubular insertion body, said tubular insertion body being provided with a tapered stem, a first end adapted for engaging the flow control device, and a second end for inserting into the open end of the tubular member, wherein the tapered stem has an outside diameter that tapers continuously from the first end to the second end, and is adapted for engaging the tubular member at the open end of the tubular member; and one or more perforations through the insertion body, the one or more perforations being located in the portion of the tapered stem positioned in the tubular member when the outside diameter of the tapered stem engages the tubular member.

2. The apparatus of claim 1 additionally comprising a seal located on the outside diameter of the tapered stem of said tubular insertion body for contacting the tubular member at the open end of the tubular member.

3. The apparatus of claim 2 wherein said seal is comprised of a material that deforms when compressed.

4. The apparatus of claim 1 additionally comprising means for forcing the second end of said tubular body into the tubular member.

5. The apparatus of claim 1 wherein the first end of said tubular insertion body forms a flange that is adapted for engaging the flow control device.

6. Apparatus for transitioning an open end of a tubular member having fluid flowing therethrough to a flow control device, said apparatus comprising an elongate tubular insertion body comprising first and second ends and a tapered stem, the first end of said tubular insertion body being adapted for engaging a the flow control device, the second end of said tubular insertion body being adapted for inserting into the open end of the tubular member and having a beveled end for maintaining a flow of fluid through said tubular insertion body, an outside diameter of said tapered stem tapering continuously from the first end to the second end, the tapered outside diameter of the stem being adapted for seating on the margins of the open end of the tubular member.

7. The apparatus of claim 6 wherein said tubular insertion body is provided with one or more perforations near the second end thereof for promoting fluid flow through said tubular insertion body as said tubular insertion body is inserted into the tubular member.

8. The apparatus of claim 6 additionally comprising a seal located on the outside diameter of said tubular insertion body for contacting the tubular member at the open end of the tubular member.

9. Apparatus for transitioning an open end of a tubular member having fluid flowing therethrough to a flow control device, said apparatus comprising an elongate tubular insertion body comprising first and second ends and a stem, the first end of said tubular insertion body being adapted for engaging a the flow control device, the second end of said tubular insertion body being adapted for inserting into the open end of the tubular member and having one or more perforations therethrough for maintaining a flow of fluid through said tubular insertion body, wherein the tapered stem has an outside diameter that tapers continuously from the first end to the second end, the perforations in the stem being located in the portion of the stem adapted for inserting into the open end of the tubular member, the stem tapering to a smaller outside diameter at the second end of said insertion body, the tapered outside diameter of the stem being adapted for seating on the margins of the open end of the tubular member.

10. The apparatus of claim 9 additionally comprising a seal located on the outside diameter of the tapered stem for contacting the tubular member at the open end of the tubular member.

11. The apparatus of claim 10 wherein said seal is comprised of a material that deforms when compressed.

* * * * *